US007319814B2

(12) United States Patent
Luo

(10) Patent No.: US 7,319,814 B2
(45) Date of Patent: Jan. 15, 2008

(54) HEAT CONDUCTING ASSEMBLY FOR A WATER HEATER, AND METHOD FOR MAKING THE HEAT CONDUCTING ASSEMBLY

(76) Inventor: Chin-Kuang Luo, 5F, No. 56, Min-Chuan Rd., Chung Dist., Taichung City (TW)

( * ) Notice: Subject to any disclaimer, the term of this patent is extended or adjusted under 35 U.S.C. 154(b) by 0 days.

(21) Appl. No.: 11/431,435

(22) Filed: May 10, 2006

(65) Prior Publication Data

US 2007/0133963 A1 Jun. 14, 2007

(30) Foreign Application Priority Data

Dec. 8, 2005 (TW) ..... 94143397 A

(51) Int. Cl.
*F24H 1/10* (2006.01)

(52) U.S. Cl. ..... 392/481; 392/441; 165/10

(58) Field of Classification Search ..... None
See application file for complete search history.

(56) References Cited

U.S. PATENT DOCUMENTS 2,748,249 A * 5/1956 Collerati ..... 392/496
2,791,204 A * 5/1957 Andrus ..... 122/33
3,492,461 A * 1/1970 Lawrence ..... 392/341
5,838,879 A * 11/1998 Harris ..... 392/451

FOREIGN PATENT DOCUMENTS

DE 3413070 A1 10/1985

* cited by examiner

*Primary Examiner*—Thor S. Campbell
(74) *Attorney, Agent, or Firm*—Trop, Pruner & Hu, P.C.

(57) ABSTRACT

In a heat conducting assembly for a water heater and a method for making the heat conducting assembly, there is provided a heat-conductive housing which has inner wall surfaces that cooperate to confine a sealed chamber. A heat-conductive unit is disposed in the sealed chamber. Heat-conductive particles are disposed in the sealed chamber, and are caused to accumulate on the inner wall surfaces of the heat-conductive housing and outer wall surfaces of the heat-conductive unit for heating water in the heat-conductive unit.

18 Claims, 4 Drawing Sheets

HEAT CONDUCTING ASSEMBLY FOR A WATER HEATER, AND METHOD FOR MAKING THE HEAT CONDUCTING ASSEMBLY

CROSS-REFERENCE TO RELATED APPLICATION

This application claims priority of Taiwanese Application No. 094143397, filed on Dec. 8, 2005.

BACKGROUND OF THE INVENTION

1. Field of the Invention

The invention relates to a heat conducting assembly, more particularly to a heat conducting assembly for a water heater, and a method for making the heat conducting assembly.

2. Description of the Related Art

Referring to FIG. 1, a conventional water heater 1, such as a gas water heater, includes an open housing 11, a heat conducting member 12, a water pipe 13 surrounding the heat conducting member 12, and a heating unit 14 disposed within the housing 11. The water pipe 13 allows water to flow therethrough, and has inlet and outlet ends 131, 132 extending out of the housing 11. In use, the heating unit 14 directly heats the heat conducting member 12, which transfers the heat to the water pipe 13 for heating the water flowing through the water pipe 13. However, the conventional water heater 1 has the following disadvantages:

1. Since only a bottom portion of the heat conducting member 12 is heated, and since the housing 11 is an open one, the heated areas of the heat conducting member 12 are limited, and heat loss is intensified due to flow of ambient air through the water heater 1, thereby resulting in low heat transfer efficiency.

2. Given the above, the heating unit 14 must consume more heat energy in order to heat the water in the water pipe 13 up to the required temperature, thereby resulting in waste of heat energy.

3. Since the bottom portion of the heat conducting member 12 is close to the heating unit 14, the part of the water pipe 13 which is proximate to the bottom portion of the heat conducting member 12 is quickly heated, whereas the part of the water pipe 13 which is distal from the bottom portion of the heat conducting member 12 is heated slowly due to the aforesaid heat loss and low heat transfer efficiency, thereby resulting in uneven heat distribution. Consequently, the water flowing through the water pipe 13 is not heated at the same rate.

SUMMARY OF THE INVENTION

Therefore, an object of the present invention is to provide a heat conducting assembly for a water heater, which has a high heat-conducting efficiency to reduce energy consumption Another object of the present invention is to provide a method for making the aforesaid heat conducting assembly.

According to one aspect of the present invention, a heat conducting assembly includes a heat-conductive housing having inner wall surfaces that cooperate to confine a sealed chamber, a heat-conductive unit disposed in the sealed chamber, and heat-conductive particles accumulating on the inner wall surfaces of the heat-conductive housing.

According to another aspect of the present invention, a heat conducting assembly is adapted for use in a water heater including an outer casing and a heat-generating source disposed in the outer casing. The heat conducting assembly includes: a heat-conductive housing adapted to be disposed in the outer casing above the heat-generating source, the heat-conductive housing having inner wall surfaces that cooperate to confine a sealed chamber; a heat-conductive unit disposed in the sealed chamber, the heat-conductive unit including a pipe body having inlet and outlet ends that extend out of the sealed chamber, the pipe body defining a flow path adapted to permit water flow from the inlet end to the outlet end; and heat-conductive particles accumulated on the inner wall surfaces of the heat-conductive housing.

According to a further aspect of the present invention, a method for making a heat conducting assembly includes: a) providing a heat-conductive housing having inner wall surfaces that cooperate to confine a sealed chamber and having a heat-conductive unit disposed therein; b) vacuuming the sealed chamber; and c) causing heat-conductive particles to accumulate on the inner wall surfaces of the heat-conductive housing.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
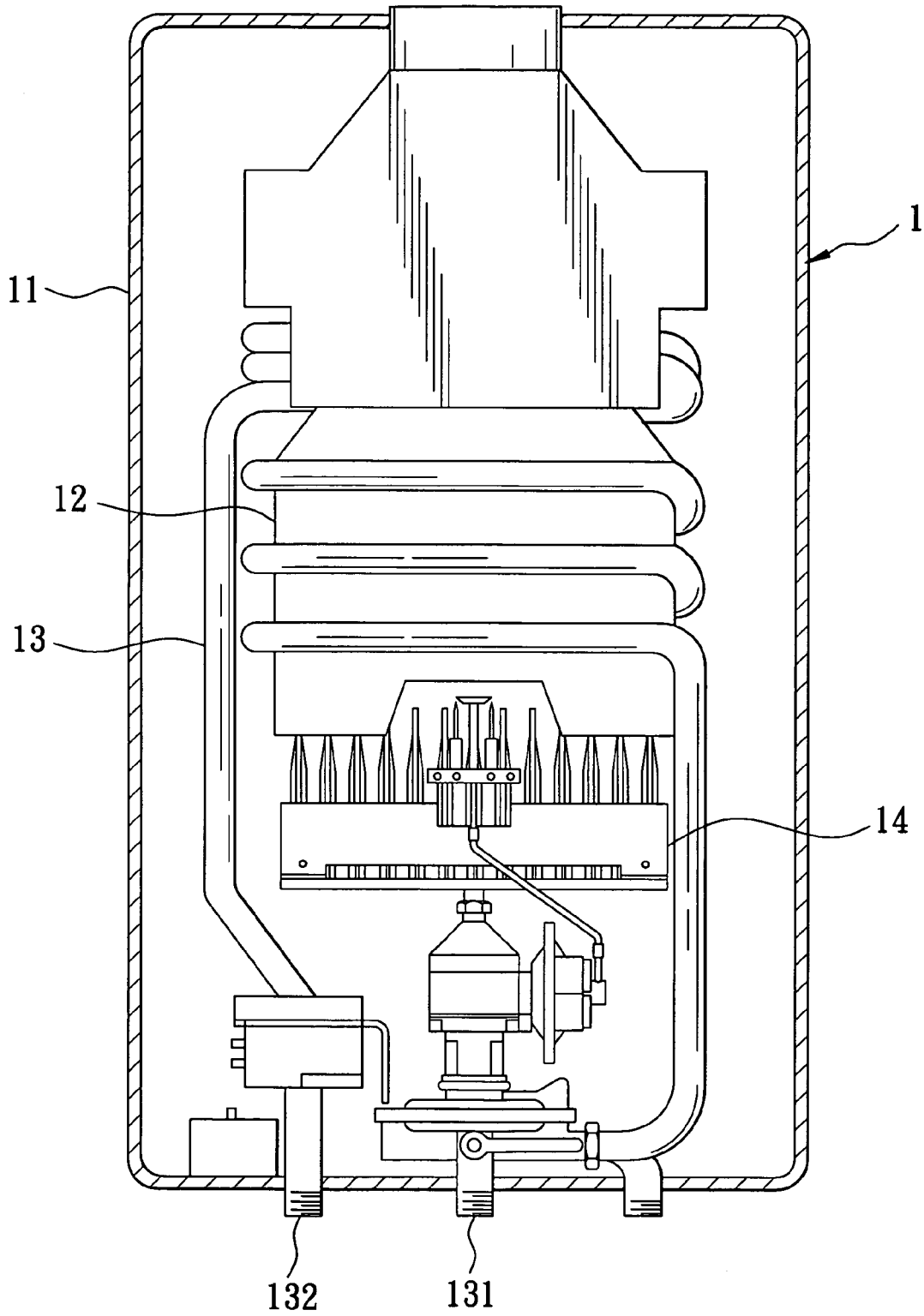
FIG. 1 PRIOR ART
FIG. 1 is a schematic partly sectional view of a conventional gas water heater.
Figure 2:
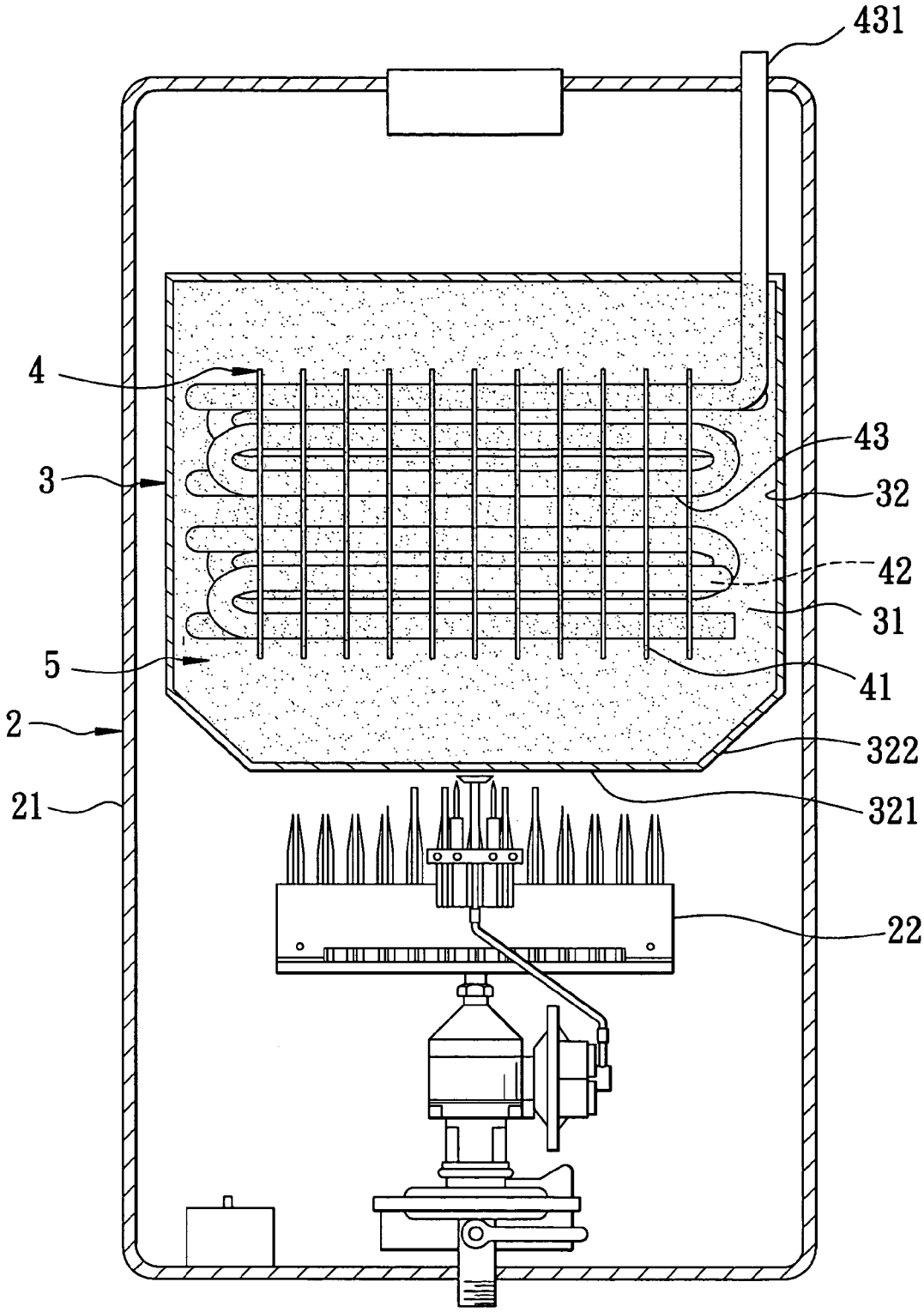
FIG. 2 is a schematic partly sectional view of a preferred embodiment of a heat conducting assembly according to the present invention when installed in a water heater.
Figure 3:
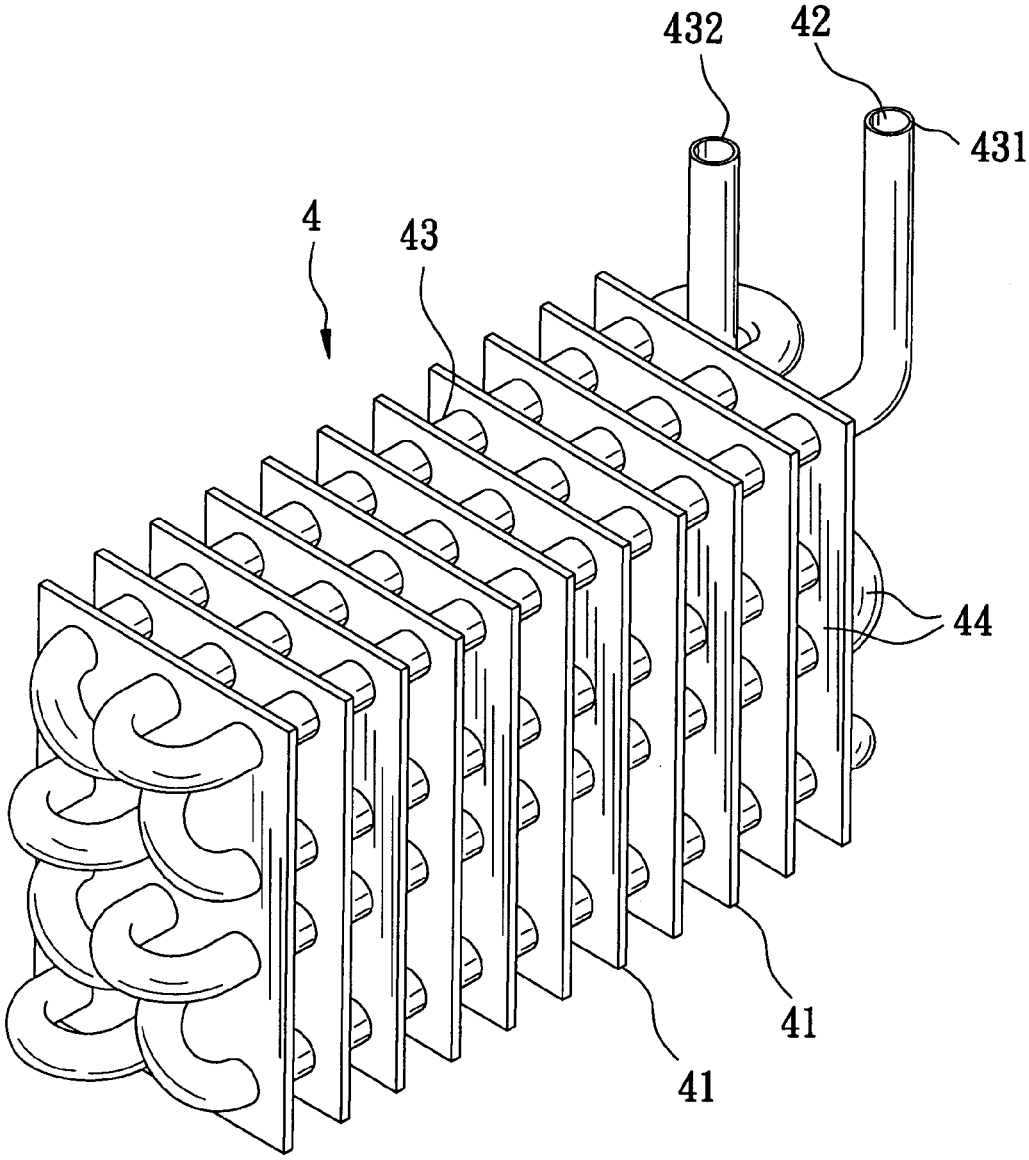
FIG. 3 is a perspective view of a heat-conductive unit of the preferred embodiment.

Referring to FIGS. 2 and 3, the preferred embodiment of a heat conducting assembly according to the present invention is adapted for use in a water heater 2. The water heater 2 includes an outer casing 21 and a heat-generating source 22 disposed in the outer casing 21. The heat-generating source 22 may be a gas burner, an electric heating element, or a solar energy converting device.

The heat conducting assembly of the present invention is shown to include a heat-conductive housing 3, a heat-conductive unit 4, and heat-conductive particles 5.

The heat-conductive housing 3 is adapted to be disposed in the outer casing 21 above the heat-generating source 22, and has inner wall surfaces 32 that cooperate to confine a sealed chamber 31. The sealed chamber 31 is vacuumed to form a vacuumed chamber. The heat-conductive housing 3 has a bottom portion that includes a bottom wall 321 and a surrounding wall 322 that extends from a periphery of the bottom wall 321 and that diverges upwardly. The heat-conductive housing 3 is made of metal in this embodiment, and may be made of other refractory materials, such as glass, resistant plastics capable of withstanding high temperatures, ceramics, etc.

The heat-conductive unit 4 is disposed in the sealed chamber 31, and includes a pipe body 43 having inlet and outlet ends 431, 432 that extend out of the sealed chamber 31. The pipe body 43 defines a flow path 42 adapted to permit water flow from the inlet end 431 to the outlet end 432. In this embodiment, the pipe body 43 is made of metal, and is a meandering pipe body. The heat-conductive unit 4 further includes a plurality of heat-conductive fin plates 41 mounted on the pipe body 43. The heat conductive fin plates 41 are arranged vertically in a spaced-apart relationship and are parallel to each other. The heat-conductive unit 4 has outer wall surfaces 44. In this embodiment, the outer wall surfaces 44 and the inner wall surfaces 32 are subjected to acid washing treatment for surface passivation so as to become passivated surfaces.

The heat-conductive particles 5 accumulate on the inner wall surfaces 32 of the heat-conductive housing 3, and further accumulate on the outer wall surfaces 44 of the heat-conductive unit 4.

Figure 4:
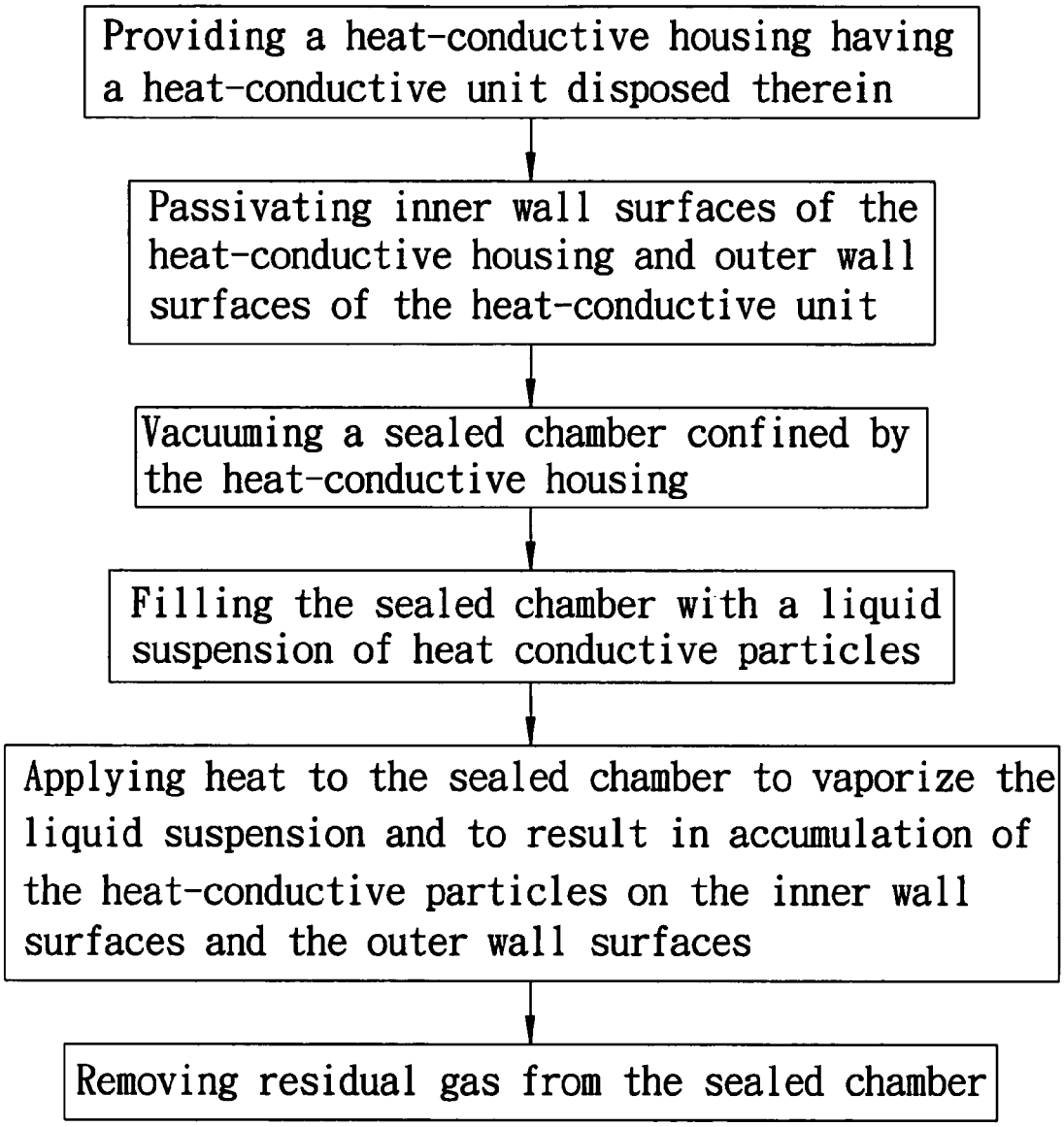
FIG. 4 is a flowchart of a preferred embodiment of a method for making the heat conducting assembly according to the present invention.

Referring to FIG. 4, in combination with FIG. 2, the preferred embodiment of a method for making the aforesaid heat conducting assembly according to the present invention is shown to include the following steps: a) providing a heat-conductive housing 3 having inner wall surfaces 32 that cooperate to confine a sealed chamber 31 and having a heat-conductive unit 4 disposed therein; b) vacuuming the sealed chamber 31; and c) causing heat-conductive particles 5 to accumulate on the inner wall surfaces 32 of the heat-conductive housing 3.

Step c) includes the sub-steps of c1) filling the sealed chamber 31 with a liquid suspension of the heat-conductive particles 5; and c2) applying heat to the heat-conductive housing 3 to vaporize the liquid suspension and to result in accumulation of the heat-conductive particles 5 on the inner wall surfaces 32 of the heat-conductive housing 3, as well as on outer wall surfaces 44 of the heat-conductive unit 4.

It is noted that the liquid suspension is composed of sintered and ground inorganic media, such as manganese and beryllium, purified water (or a volatile liquid such as alcohol), and zinc, magnesium and calcium which can inhibit generation of hydrogen and oxygen.

The method further includes passivating the outer wall surfaces 44 of the heat-conductive unit 4 and the inner wall surfaces 32 of the heat-conductive housing 3 in step a) so as to facilitate accumulation of the heat-conductive particles 5 thereon. Passivation of the outer wall surfaces 44 of the heat-conductive unit 4 and the inner wall surfaces 32 of the heat-conductive housing 3 is conducted through acid washing treatment.

The method further includes vacuuming the sealed chamber 31 after step c) to remove residual gas from the sealed chamber 31. Although some heat-conductive particles 5 may be removed during the vacuuming operation, the amount removed is not significant.

In use, when the heat-generating source 22 heats the heat-conductive housing 3, heat is transferred to the heat-conductive unit 4 via three mechanisms: (a) thermal radiation of the heat-conductive housing 3; (b) the temperature difference between the heat-conductive housing 3 and the heat-conductive unit 4 that can cause the heated heat-conductive particles 5 to move toward the heat-conductive unit 4 (i.e., through convection); and (c) contact between the heated heat-conductive particles 5 and the heat-conductive unit 4 (i.e., conduction).

It is noted that the configuration of the bottom portion of the heat-conductive housing 3 which includes the bottom wall 321 and the diverging surrounding wall 322 can guide the heat-conductive particles 5 to accumulate on the bottom wall 321 to be relatively close to the heat-generating source 22 for quick heat conduction. Moreover, as the sealed chamber 31 is in a vacuum and dry state, condensation of water vapor on the pipe body 43 will not occur when heat is transferred to the pipe body 43. Besides, the pressure inside the sealed chamber 31 can be maintained at a constant level due to the capability of zinc, magnesium and calcium to inhibit the generation of hydrogen and oxygen.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A heat conducting assembly comprising:

a heat-conductive housing having inner wall surfaces that cooperate to confine a sealed chamber;

a heat-conductive unit disposed in said sealed chamber; and heat-conductive particles accumulated on said inner wall surfaces of said heat-conductive housing, said heat-conductive unit having outer wall surfaces, said outer wall surfaces of said heat-conductive unit being passivated surfaces, said heat-conductive particles further accumulating on said outer wall surfaces of said heat-conductive unit.

2. The heat conducting assembly as claimed in claim 1, wherein said sealed chamber is a vacuumed chamber.

3. The heat conducting assembly as claimed in claim 1, wherein said heat-conductive unit includes a pipe body having inlet and outlet ends that extend out of said sealed chamber, said pipe body defining a flow path to permit water flow from said inlet end to said outlet end.

4. The heat conducting assembly as claimed in claim 3, wherein said pipe body is made of metal.

5. The heat conducting assembly as claimed in claim 3, wherein said pipe body is a meandering pipe body.

6. The heat conducting assembly as claimed in claim 5, wherein said heat-conductive unit further includes a plurality of heat-conductive fin plates mounted on said pipe body.

7. The heat conducting assembly as claimed in claim 1, wherein said outer wall surfaces of said heat-conductive unit are subjected to acid washing treatment for surface passivation.

8. The heat conducting assembly as claimed in claim 1, wherein said heat-conductive housing has a bottom portion that includes a bottom wall and a surrounding wall that extends from a periphery of said bottom wall and that diverges upwardly.

9. A heat conducting assembly adapted for use in a water heater, the water heater including an outer casing and a heat-generating source disposed in the outer casing, said heat conducting assembly comprising:

a heat-conductive housing adapted to be disposed in the outer casing above the heat-generating source, said heat-conductive housing having inner wall surfaces that cooperate to confine a sealed chamber;

a heat-conductive unit disposed in said sealed chamber, said heat-conductive unit including a pipe body having inlet and outlet ends that extend out of said sealed chamber, said pipe body defining a flow path adapted to permit water flow from said inlet end to said outlet end; and heat-conductive particles accumulated on said inner wall surfaces of said heat-conductive housing, said heat-conductive unit having outer wall surfaces, said outer wall surfaces of said heat-conductive unit being passivated surfaces, said heat-conductive particles further accumulating on said outer wall surfaces of said heat-conductive unit.

10. The heat conducting assembly as claimed in claim 9, wherein said sealed chamber is a vacuumed chamber.

11. The heat conducting assembly as claimed in claim 9, wherein said pipe body is made of metal.

12. The heat conducting assembly as claimed in claim 9, wherein said pipe body is a meandering pipe body.

13. The heat conducting assembly as claimed in claim 12, wherein said heat-conductive unit further includes a plurality of heat-conductive fin plates mounted on said pipe body.

14. The heat conducting assembly as claimed in claim 9, wherein said outer wall surfaces of said heat-conductive unit are subjected to acid washing treatment for surface passivation.

15. The heat conducting assembly as claimed in claim 9, wherein said heat-conductive housing has a bottom portion that includes a bottom wall and a surrounding wall that extends from a periphery of said bottom wall and that diverges upwardly.

16. A method for making a heat conducting assembly, comprising:

a) providing a heat-conductive housing having inner wall surfaces that cooperate to confine a sealed chamber and having a heat-conductive unit disposed therein;

b) vacuuming the sealed chamber; and c) causing heat-conductive particles to accumulate on the inner wall surfaces of the heat-conductive housing, wherein the heat-conductive particles further accumulate on outer wall surfaces of the heat-conductive unit, and wherein step (a) includes passivating the outer wall surfaces of the heat-conductive unit.

17. The method of claim 16, wherein step c) includes:

c1) filling the sealed chamber with a liquid suspension of the heat-conductive particles; and c2) applying heat to the heat-conductive housing to vaporize the liquid suspension and to result in accumulation of the heat-conductive particles on the inner wall surfaces of the heat-conductive housing.

18. The method of claim 15, wherein passivation of the outer wall surfaces of the heat-conductive unit is conducted through acid washing treatment.

* * * * *